US006346353B1

(12) United States Patent
Wang et al.

(10) Patent No.: US 6,346,353 B1
(45) Date of Patent: Feb. 12, 2002

(54) PROTECTIVE EPOXY OVERCOAT FOR IMAGING ELEMENTS

(75) Inventors: Yongcai Wang; Kevin M. O'Connor; Tiecheng A. Qiao, all of Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/699,815

(22) Filed: Oct. 30, 2000

(51) Int. Cl.[7] ..... G03C 11/06; G03C 11/08; G03C 1/76; G03C 5/26; B41J 3/407

(52) U.S. Cl. ..... 430/14; 430/350; 430/463; 430/512; 430/531; 430/536; 430/537; 430/961; 430/235; 430/207; 430/237; 347/105; 347/106

(58) Field of Search ..... 430/350, 14, 444, 430/463, 531, 536, 537, 961, 512; 347/105, 106

(56) References Cited

U.S. PATENT DOCUMENTS 4,554,235 A * 11/1985 Adair et al. ..... 430/961
4,797,353 A * 1/1989 Yamada et al. ..... 430/961
5,853,926 A * 12/1998 Bohan et al. ..... 430/350
5,856,051 A * 1/1999 Yau et al. ..... 430/537
6,153,363 A * 11/2000 Nair et al. ..... 430/536
6,187,517 B1 * 2/2001 Whitesides et al. ..... 430/537
6,190,843 B1 * 2/2001 Yau et al. ..... 430/537
6,194,130 B1 * 2/2001 Nair et al. ..... 430/531
6,232,049 B1 * 5/2001 Nair et al. ..... 430/531

* cited by examiner

*Primary Examiner*—Richard L. Schilling
(74) *Attorney, Agent, or Firm*—Chris P. Konkol

(57) ABSTRACT

The present invention relates to imaged elements having a protective overcoat that resists fingerprints, common stains, and spills. In particular, an overcoat composition comprising water-dispersible epoxy-functional particles is coated over an imaging element, including photographic elements and recording media. In one embodiment, a photographic element includes a support, at least one silver halide emulsion layer superposed on the support and a processing-solution-permeable protective overcoat overlying the silver halide emulsion layer that, after fusing, becomes water-resistant in the final product. The present invention is also directed to a method of making a print involving developing the photographic element and subsequently fusing the overcoat.

16 Claims, No Drawings

PROTECTIVE EPOXY OVERCOAT FOR IMAGING ELEMENTS

FIELD OF THE INVENTION

The present invention relates to imaged elements having a protective overcoat that resists fingerprints, common stains, and spills. In particular, the invention is directed to an overcoat composition comprising a water-dispersible epoxy-functional latex is coated over an imaged element, including photographic elements and recording media. A method of forming a protective overcoat on an imaging element is also disclosed.

BACKGROUND OF THE INVENTION

Gelatin has been used extensively in a variety of imaging elements as the binder because of its many unique and advantageous properties. For example, its property of water swellability allows processing chemistry to be carried out to form silver halide-based photographic images, and its hydrophilic nature allows gelatin to function as an ink-receiver in ink-jet recording media. For a photographic element, an aqueous solution needs to penetrate the surface of the element to contact the silver halide and couplers necessary for dye image formation. For an ink-jet recording element, an aqueous dye solution needs to be absorbed very quickly by the element or media to fix the dye image. Therefore, water-soluble polymers or materials that have affinity with water are proven to be the binders of choice for these imaging elements. However, while these materials are good for image development, they are not strong enough to resist mechanical damage such as scratching, tearing, and other types of deformation. Furthermore, the imaged elements, after image formation is complete, have very little resistance to fingerprints or to stains from food and drink spills. Imaging elements with exposed gelatin-containing materials, no matter if they are formed on transparent or reflective media, need to be handled with extreme care so as not to come into contact with aqueous solutions that may damage the images. Accidental spillage of common household solutions such as coffee, punch, or even plain water can damage imaged elements such as ink-jet, electrophotographic, or photographic prints.

There have been attempts over the years to provide protective layers for gelatin based photographic systems that will protect the images from damage by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. U.S. Pat. No. 5,376,434 describes a protective layer formed on a photographic print by coating and drying a latex on a gelatin-containing layer bearing an image. The latex is a resin having a glass transition temperature of from 30° C. to 70° C. The application of UV-polymerizable monomers and oligomers on processed image followed by radiation exposure to form crosslinked protective layer is described in U.S. Pat. No. 4,092,173. A drawback for both the solvent coating method and for the radiation cure method is the health and environmental concern of those chemicals or radiation to the coating operator. Another drawback is that the photographic materials need to be coated after the processing step. Thus, the processing equipment needs to be modified and the personnel running the processing operation need to be trained to apply the protective coating.

Alternatively lamination can be used to provide an imaged element with resistance to scratch, water, and stain resistance. Lamination involves placing a durable and/or adhesive protective layer coated on a suitable support to the image which is to be protected. The support of the protective coating may remain permanently adhered or it may subsequently be peeled off leaving only the protective layer adhered to the image. Lamination has several disadvantages in that it brings about an added expense associated with coating an additional support. In addition, air pockets may be trapped during the laminating step leading to image defects.

Protective coatings that need to be applied to the image after it is formed, several of which were mentioned above, adds a significant cost to the final imaged product. A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene have a melting temperature (Tm) of 55 to 200° C., and are therefore capable of forming a water-resistant layer by fusing the layer at a temperature higher than the Tm of the polymer after the sample has been processed to generate the image. The coating solution is aqueous and can be incorporated in the manufacturing coating operation without any equipment modification.

It can be seen that various approaches have been attempted to obtain an imaged imaging element with resistance to water and mechanical damages. However, the aforementioned prior art references are deficient with regarding to simultaneously satisfying the performance, environmental, and cost requirements. Also, in recent years, the use by the public of various printing and imaging technologies in the publishing industry as well as at home increasingly becomes more popular. It becomes increasingly more desirable to provide protection for the imaged or printed documents against abrasion, transfer cover materials, water or alcohol spills, ink smear, or other image print degradation processes and detrimental effects from the surroundings. It would be desirable to obtain a water-resistant imaged element with a protective overcoat with superior properties that avoids the problems and limitations of the prior art.

SUMMARY OF THE INVENTION

The present invention relates to a protective overcoat for an imaged element that provides water resistance, fingerprint resistance, and the like. This protective overcoat composition comprises epoxy-containing particles comprising at least 50% by dry weight of a solid epoxy compound or resin and which particles having a glass transition temperature of greater than 20° C. and a mean particle size of less than five microns. The overcoat composition further comprises, in the epoxy-containing particle, a polymer having acid groups. The protective overcoat composition also comprises a binder material for the epoxy-containing particles.

In one embodiment of the invention, the overcoat composition applied to the imaging element comprises 30 to 95 weight percent, based on the dry laydown of the overcoat, of water-dispersible polymer epoxy-containing particles having an average of between 0.01 to 0.5 micrometers, said water-dispersible polymer being characterized by a $T_g$ (glass transition temperature) of greater than 20° C. and 5 to 70 percent of binder. The balance can be up to and the balance materials such as surfactants, lubricants, thickeners. In the case of a photographic element, the imaging element comprises a support, at least one silver-halide emulsion layer superposed on the support, and overlying the silver-halide emulsion layer, a processing-solution-permeable overcoat composition that can be coated onto the imaging element during manufacturing and that does not inhibit photographic processing.

Another aspect of the invention provides for a method of forming an image in the imaging element described above and converting the overcoat into a water-resistant coating, including the use of fusing to convert the overcoat to a water-resistant protective overcoat.

DESCRIPTION OF THE PREFERRED EMBODIMENTS

The present invention provides a simple and inexpensive way to improve the water, stain and abrasion resistance of imaged elements. In accordance with the invention, a nascently protective overcoat is applied over an imaging element prior to image formation or processing. In particular, an overcoat according to the present invention is present over the emulsion side of photographic products or the image-receiving side of image-recording media, particularly photographic prints or ink-jet prints of real-life images, which prints may encounter frequent handling and abuse by end users.

By the term "water-resistant" is meant herein that, after ordinary processing for image formation, an imaged element does not imbibe water. Water-based stains that can discolor the imaged side of the element is prevented or minimized.

By the term "elevated temperature", as used in this application, to dry and/or facilitate coalescence of the water-dispersible polymer, is herein meant a temperature of from 30 to 100° C., preferably 45 to 60° C. In contrast, fusing generally requires simultaneous application of heat and pressure, for example employing a pressure roller or belt. Drying of the imaged element before fusing is recommended. Fusing generally requires higher temperatures, typically above the boiling point of water, usually above 100° C.

The present invention provides an improved overcoat for the imaged side of an imaged element or material, including photographic prints, which encounter frequent handling and abuse by end users. The overcoat is made from an overcoat formulation comprising 30 to 95% by weight (based on the dry laydown of the overcoat) of water-dispersible epoxy-containing particles of 0.01 to 0.5 micrometers in average size and 5 to 70% by weight of a hydrophilic polymer (based on the dry laydown of the overcoat).

In one embodiment of the invention, the applied overcoat composition of the photographic element comprises 30 to 95% by weight of solids, preferably 60 to 90 weight percent, of water-dispersible polymer particles having an average particle size of less than 500 nm and a $T_g$ of greater than 20° C., preferably from 20° C. to 70° C., and 5 to 70%, by weight of solids, preferably 10 to 40 weight percent, of a hydrophilic polymer; wherein the weight ratio of the water-dispersible epoxy-containing particles to the hydrophilic polymer is from 20:80 to 95:5, preferably from 40:60 to 90:10, more preferably between 50:50 and 80:20, whereby the overcoat forms a water-resistant overcoat upon fusing, after image formation, namely by heating the image element under pressure to a temperature of at least 100° C. The epoxy particles of the invention have a mean size of less than 5 microns, preferably less than 2 microns.

The epoxy-containing particles comprises a material, a compound or resin, having a 1,2-epoxy functionality, more particularly, having on average greater than about 1.5 epoxide groups per molecule (on a measured basis). The epoxy material can be saturated or unsaturated, linear or branched, aliphatic, cycloaliphatic, aromatic or heterocyclic, and may bear substituents which do not materially interfere with the reaction with the carboxylic acid. Such substituents can include bromine or fluorine. The epoxy material may be monomeric or polymeric. Suitable epoxy resins include glycidyl ethers prepared by reacting epichlorohydrin with a compound containing at least 1.5 aromatic hydroxyl groups carried out under alkaline reaction conditions. Examples of other epoxy resins suitable for use in the invention include diglycidyl ethers of dihydric compounds, epoxy novolacs (substituted or unsubstituted phenyl-containing epoxy materials) and cycloaliphatic epoxies. Generally, epoxy resins contain a distribution of compounds with a varying number of repeat units.

Preferably, the epoxy material is a resin that is a diglycidyl ether of a dihydric phenol, a diglycidyl ether of a hydrogenated dihydric phenol, an aliphatic glycidyl ether, an epoxy novolac, or a cycloaliphatic epoxy. Diglycidyl ethers of dihydric phenols can be produced, for example, by reacting an epihalohydrin with a dihydric phenol in the presence of an alkali. Examples of suitable dihydric phenols include: 2,2-bis(4-hydroxyphenyl) propane(bisphenol-A); 2,2-bis(4-hydroxy-3-tert-butylphenyl) propane; 1,1-bis(4-hydroxyphenyl) ethane; 1,1-bis(4-hydroxyphenyl) isobutane; bis(2-hydroxy-1-naphthyl) methane; 1,5-dihydroxynaphthalene; 1,1-bis(4-hydroxy-3-alkylphenyl) ethane and the like. Suitable dihydric phenols can also be obtained from the reaction of phenol with aldehydes such as formaldehyde (bisphenol-F). Diglycidyl ethers of dihydric phenols include advancement products of the above diglycidyl ethers of dihydric phenols with phenolic compounds such as bisphenol-A, such as those described in U.S. Pat. Nos. 3,477,990 and 4,734,468. Diglycidyl ethers of hydrogenated dihydric phenols can be produced, for example, by hydrogenation of dihydric phenols followed by glycidation reaction with an epihalohydrin in the presence of a Lewis acid catalyst and subsequent formation of the glycidyl ether by reaction with sodium hydroxide.

Aliphatic glycidyl ethers can be produced, for example, by reacting an epihalohydrin with an aliphatic diol in the presence of a Lewis acid catalyst followed by conversion of the halohydrin intermediate to the glycidyl ether by reaction with sodium hydroxide. Examples of suitable aliphatic glycidyl ethers include for example, diglycidyl ethers of 1,4 butanediol, neopentyl glycol, cyclohexane dimethanol, hexanediol, polypropylene glycol, and like diols and glycols; and triglycidyl ethers of trimethylol ethane and trimethylol propane. Epoxy novolacs can be produced by condensation of formaldehyde and a phenol followed by glycidation by reaction of an epihalohydrin in the presence of an alkali. The phenol can be, for example, phenol, cresol, nonylphenol and t-butylphenol. Cycloaliphatic epoxies can be produced by epoxidizing a cycloalkene-containing compound with greater then one olefinic bond with peracetic acid.

Commercial examples of preferred epoxy resins include, for example, EPON™ resin 1001F, 1002F, 1004F, 1007F, 1009F, 2002, 2003, 2004, 2005, 2012, 2014, 2024, 2042, 3001, 3002 available from Shell Chemical Company, and epoxy cresol novolac resin (poly((o-cresyl glycidyl ether)-co-formaldehyde)) available from Sigma-Aldrich Chemical Co.

In one embodiment of the present invention, the water-dispersible epoxy particles, may comprise, in addition to the epoxy material, a substantially amorphous, thermoplastic polymer having carboxylic acid groups, which polymer can be characterized by an acid number. Preferably, the acid number is less than or equal to 250, more preferably less than or equal to 100. Such carboxylated thermoplastic polymers are preferably prepared by conventional free radical polymerization techniques from at least one ethylenically unsaturated monomer and at least one ethylenically unsaturated acid monomer. The choice of the unsaturated monomer(s) is dictated by the intended end use of the coating composition and is practically unlimited. A variety of acid monomers can be used. Their selection is dependent on the desired final polymer properties.

This acid monomer can be an ethylenically unsaturated acid, mono-protic or diprotic, anhydride or monoester of a dibasic acid, which is copolymerizable with the other monomer(s) used to prepare the polymer. The most preferred acid monomers are acrylic acid, methacrylic acid, and itaconic acid.

Preferably, the acid number of the carboxylated thermoplastic polymers is between 30 and 250, preferably between 30 and 200. The acid number is the number of milligrams of potassium hydroxide required to neutralize one gram of the polymer. For purposes of illustration, an acid number of 100 corresponds to the presence in the polymer of either 12.8% acrylic acid, 15.3% of methacrylic acid, 11.5% of itaconic acid, or 10.3% of maleic or fumaric acid.

Ethylenically unsaturated monomers which can be used for preparing a carboxylated thermoplastic polymer include virtually all monomers capable of undergoing addition polymerization to produce polymers free of ionic charge groups and essentially water-insoluble. Typical useful monomers thus include, for example, methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, 2-hydroxypropyl methacrylate acrylonitrile, methacrylonitrile, vinyl acetate, vinyl propionate, vinylidene chloride, vinyl chloride, styrene, t-butyl styrene, vinyl toluene, butadiene, isoprene, and the like.

The polymerization process is initiated in general with free radical initiators. Free radicals of any sort may be used. Preferred initiators include persulfate, peroxides, azo compounds, and redox initiators. The amount of initiator can vary from 0.01% to 2% by the weight of monomer, but is preferably from 0.03 to 1% by weight thereof. Organic peroxides and organic peresters include, for example, benzoyl peroxide, dichlorobenzoyl peroxide, dicumyl peroxide, di-tert-butyl peroxide, lauroyl peroxide, tert-butyl peracetate, 2,5-dimethyl-2,5-di (tert-butylperoxy)hexine-3, 2,5-dimethyl-2,5-di(tert-butylperoxy) hexane, tert-butyl perbenzoate, tert-butyl perphenyl acetate, tert-butlyperisobutylate, tert-butyl per-secoctoate, tert-butyl perpivalate, cumyl perpivalate and tert-butyl perdiethyl acetate, and azo compounds include, for example, azobisisobutylnitrile and dimethyl azoisobutylate.

The epoxy-containing particles of the invention can be prepared by various methods known in the art. For example, they can be prepared by pulverizing and classifying the particle material or by spray drying of a solution containing the particle material, including a epoxy resin, followed by redispersing the resultant particles in water using a dispersant. They can be prepared by a suspension technique that consists of dissolving the particle material, including an epoxy compound in, for example, a water immiscible solvent, dispersing the solution as fine liquid droplets in an aqueous solution, and removing the solvent by evaporation or other suitable techniques. They can be prepared by mechanically grinding the particle material, including an epoxy compound, in water to a desired particle size in the presence of a dispersant, heating the epoxy-containing particles dispersed in water to above their melting points, and cooling the melted particles in water to form a stable dispersion. They can be prepared by the so-called "atmospheric emulsification" and "pressure emulsification" techniques. The atmospheric process can be used to prepare epoxy-containing dispersions for epoxy resins with melting points below the boiling point of water. The process typically consists of melting an epoxy compound and a surfactant together. Optionally a base is added to the melt. Hot water is then slowly added to the epoxy melt at vigorous agitation. Pressure emulsification is generally needed for epoxy resins with a melting point greater than 100° C. It is similar to the atmospheric process except at temperature above the water boiling point. Vessels capable of withstanding high pressure are normally needed for such a method.

Various dispersants and surfactants known in the art can be used as stabilizers. The dispersants can be nonionic, anionic, and cationic, and can be polymeric and are used as high as 20% of the epoxy resin. Because such surfactants are potential of causing other problems, the minimum amount of surfactant should be used. Commercial dispersions of epoxy resins often contain a minor amount of surfactant. If the dispersion of epoxy material coagulates or coalesces, then addition of measured amounts of surfactant to freshly prepared dispersions or to the aqueous phase preparatory to formation of the dispersion can be used to assess the stability of the dispersion. Most preferably, the dispersion will be stable with regards to sedimentation of the epoxy-containing dispersed phase. However, in the context of the subject invention, the term "stable" refers to a dispersion where the epoxy resin particles do not coalesce or coagulate, but remain substantially in distinct particles. If such particles sediment upon storage, they may be easily redispersed by shaking or moderate agitation. If, however, the particles coalesce, they cannot be redispersed without high shear mixing for prolonged periods of time.

Commercially available epoxy dispersions may be used in the practice of the invention. Such dispersions are available from a number of manufacturers, for example from Ciba-Geigy as ECN-1400®, a dispersion of epoxy novolac ECN 1299® in water; and Epi-Rez.RTM. 35201®, a dispersion of a solid DGEBA® epoxy resin, CMD W50-3519®, an elastomer modified epoxy dispersion, and W55-50033® or SU-3® epoxy dispersion, all available from Rhone-Poulenc.

A preferred method of making epoxy-containing particles for a coating composition according to one embodiment of the present invention comprises (1) dissolving into a volatile solvent mixture an oil-soluble epoxy-functional compound and a polymer having an acid number greater than 30 and less than 250 and optionally a surfactant, (2) adding to the organic solvent medium in a base to neutralize the acid groups to a degree of neutralization less than 95%, preferably less than 90%, (3) dispersing the resulting organic phase into an aqueous medium optionally containing a surfactant, and (4) removing the volatile solvent mixture. Preferably, the volatile solvent mixture comprises a water immiscible organic solvent as the major component and a water miscible organic solvent as a minor component. Such a process advantageously provides very fine submicron particles having a narrow particle size distribution. The dispersions also have excellent stability during storage.

The protective overcoat preferably comprises, in addition to the water-dispersible epoxy particles described above, at least one hydrophilic polymer as a binder. Examples of hydrophilic polymers that may be added include polyvinyl alcohol, cellulose ethers, poly(N-vinyl amides), polyacrylamides, polyesters, poly(ethylene oxide), dextrans, starch, uncrosslinked or crosslinked gelatin, polyvinylpyrollidone, whey, albumin, poly(acrylic acid), poly(ethyl oxazolines), alginates, gums, poly(methacrylic acid), poly(oxymethylene), poly(ethyleneimine), poly (ethylene glycol methacrylate), poly(hydroxy-ethyl methacrylate), poly(vinyl methyl ether), poly(styrene sulfonic acid), poly(ethylene sulfonic acid), poly(vinyl phosphoric acid) and poly(maleic acid) and the like. Such materials are included in "Handbook of Water-Soluble Gums and Resins" by Robert l. Davidson (McGraw-Hill Book Company, 1980) or "Organic Colloids" by Bruno Jirgensons (Elsvier Publishing Company, 1958). In a preferred embodiment, the polymer is gelatin, which polymer has been found to yield coatings that are relatively uniform and to enhance the diffusion rate of the developer into the underlying emulsions, in the case of photographic elements.

The protective overcoat, after fusing, should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl) sulfosuccinate (Aerosol® OT commercially available from American Cyanamide, Wayne, N.J.), and alkylcarboxylate salts such as sodium decanoate.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the overcoat composition may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No.308119, published December 1989, page 1006.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874,205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008. Preferably, a commercial embodiment involve simultaneous co-extrusion. The laydown of the overcoat will depend on its field of application. For a photographic element, the laydown of the polyurethane-containing copolymer is suitably at least 0.54 $g/m^2$ (50 $mg/ft^2$), preferably 1.08 to 5.38 $g/m^2$ (100 to 500 $mg/ft^2$), most preferably 1.61 to 3.23 $g/m^2$ (150 to 300 $mg/ft^2$). After applying the coating composition to the support, it may be dried over a suitable period of time, for example 2 to 4 minutes.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer latices to improve dimensional stability, hardeners or cross-linking agents, surfactants, matting agents, lubricants, and various other well-known additives can be present in any or all of the above mentioned layers.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. Nos. 4,279,945 and 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of using a composition according to the present invention, a photographic element may be provided with a processing-solution-permeable overcoat having the above described composition overlying the silver halide emulsion layer superposed on a support. The photographic element is developed in an alkaline developer solution having a pH greater than 7, preferably greater than 8, more preferably greater than 9. This allows the developer to penetrate the protective coating. After the pH is reduced, for example in a bleach fix solution, the protective overcoat becomes relatively water resistant. The addition of polyvinyl alcohol, according to one embodiment of the present invention, facilitates this method. It has been found the polyvinyl alcohol can provide improved wettability of the surface during processing and, at the same time, allows more of the polyvinyl alcohol to be washed out during the processing, so that the final product is more water resistant. Suitably at least 30%, preferably greater than 50%, more preferably greater than 75% of the original amount of PVA in the overcoat is washed out during processing of the exposed photographic element, such that the final product is depleted in hydrophilic polymer and hence relatively more water resistant. Although the processing-solution-permeable overcoat does not require fusing, optional fusing may improve the water resistance further The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping. The present invention also applies to imaged recording elements in which the images, for example, are derived from a pixel-based picture made with a digital still camera. The image can be formed in one or more recording layers, for example as produced using ink-jet printing or electrophotographic printing. Ink-jet printing technology is reviewed in an article titled "Progress and Trends in Ink-Jet Printing Technology" by Hue P. Le in the Journal of Imaging Science and Technology, Volume 42, Number 1 (January/February 1998), pp. 49–61. Essentially, ink droplets, typically in the volume range 1–100 picoliters, are ejected from a printhead to a receiver material on which the image is formed. The ink-jet printhead may be of the continuous or drop-on-demand varieties. Several physical mechanisms for drop ejection are known, but the currently most popular among these are thermal and piezoelectric. In the thermal mechanism, ink in the printhead is heated to form a water vapor bubble that expels one or more ink droplets out of the printhead toward the receiver. Representative thermal ink-jet printheads are described in, for example, U.S. Pat. No. 4,723,129 of Endo et al. (Canon) and U.S. Pat. No. 4,490,728 of Vaught et al. (Hewlett Packard). In the piezoelectric mechanism, one or more droplets are expelled from the printhead by a physical deformation that accompanies a voltage change across a piezoelectric material forming a part of the printhead structure. Representative piezoelectric printheads are described in, for example, U.S. Pat. No. 4,459,601 of Howkins (Exxon) and U.S. Pat. No. 5563634 of Masahiro et al. (Seiko Epson).

The carrier for the ink-jet inks may be comprised solely of water or can be predominantly water mixed with water soluble solvents such as polyhydric alcohols or can be predominantly organic materials such as polyhydric alcohols. The dyes used in such compositions are typically water-soluble direct or acid type dyes. Such liquid ink compositions have been described extensively in the prior art, including, for example, U.S. Pat. No. 4,781,758.

In addition to water and one or more colorants, such as dyes or pigments, an aqueous ink typically contains one or more humectants, which affect ink viscosity and volatility, one or more surfactants, which affect the wetting and penetrating properties of the ink, and a biocide, which extends the useful life of the ink. Aqueous inks may also contain many other ingredients, including metal ion chelating agents, pH buffers, defoamers, and dispersing agents. It is well known to improve the tone scale or bit depth of an image by using more than one ink density for each color. Representative ink-jet inks are described in, for example, U.S. Pat. No. 5,571,850 of Ma et al. (DuPont), U.S. Pat. No. 5, 560,770 of Yatake (Seiko Epson), and U.S. Pat. No. 5,738,716 of Santilli et al. (Eastman Kodak).

Ink-jet media or receivers may be reflective, transparent, or of intermediate transparency (e.g., for day/night display materials). At minimum, an ink-jet receiver includes a support and an ink receiving layer. The simplest ink-jet receiver is plain paper, in which these two functions are combined. As a practical matter, more complex receiver structures are required for improved image quality and physical properties. Specifically formulated ink receiving layers coated on paper or other supports improve color density and dot resolution. Receiver composition and structure may also be modified to improve properties such as wettability, ink absorptivity, drying time, gloss, reduced image artifacts, waterfastness, and light and dark stability. Representative ink-jet receiver structures and compositions are described in, for example, U.S. Pat. No. 4,954,395 of Hasegawa et al. (Canon), U.S. Pat. No. 5,725,961 of Ozawa et al. (Seiko Epson), and U.S. Pat. No. 5,605,750 of Romano et al. (Eastman Kodak).

The use of the present invention in the context of typical recording elements will now be described in more detail. Any support or substrate may be used in a recording element, for example, plain or calendered paper, paper coated with protective polyolefin layers, polymeric films such as poly(cthylene terephthalate), poly(ethylene naphthalate), poly(1,4-cyclohexane dimethylene terephthalate), polyvinyl chloride, polyimide, polycarbonate, polystyrene, or cellulose esters. In particular, polyethylene-coated paper or poly(ethylene terephthalate) is preferred.

The support is suitably of a thickness of from about 50 to about 800 $\mu$m, preferably from about 75 to 500 $\mu$m. Antioxidants, antistatic agents, plasticizers, dyes, pigments and other known additives may be incorporated into the support, if desired.

In order to improve the adhesion of the image-recording layer to the support, the surface of the support may be optionally subjected to a corona-discharge treatment prior to applying the image-recording layer.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include amorphous and crystalline silicas, poly(methyl methacrylate), hollow sphere polystyrene beads, micro crystalline cellulose, zinc oxide, talc, and the like. The filler loaded in the backing layer is generally less than 5 percent by weight of the binder component and the average particle size of the filler material is in the range of 5 to 30 $\mu$m. Typical binders used in the backing layer are polymers such as acrylates, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonate sodium salt, octyl-sulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder. An image-recording layer may also be coated on the backside, if desired.

Preferably, the support in a recording element is coated with an image forming layer or layers of materials capable of absorbing the carrier and/or dyes in the ink. The thickness of this layer is typically from 5 to 50 micrometers ($\mu$m). The material may include a hydrophilic polymer, including naturally-occuring hydrophilic colloids and gums such as gelatin, albumin, guar, xantham, acacia, chitosan, starches and their derivatives, functionalized proteins, functionalized gums and starches, and cellulose ethers and their derivatives, polyvinyloxazoline and polyvinylmethyloxazoline, polyoxides, polyethers, poly(ethylene imine), poly(acrylic acid), poly(methacrylic acid), n-vinyl amides including polyacrylamide and polyvinylpyrrolidone, and poly(vinyl alcohol), its derivatives and copolymers. Poly(vinyl alcohol) and its derivatives are preferred hydrophilic absorbing materials for use in ink receptive coatings. This layer may also comprise a microporous material. Preferred microporous materials are silica, alumina, or hydrated alumina, boehmite, mica, montmorillonite, kaolite,talc, vermiculite, zeolites, calcium silicate, titanium oxide, barium sulfate, and the like, optionally in combination with a polymeric binder. See, for example, U.S. Pat. No. 5,605,750, incorporated by reference. Many known microporous materials may be employed, including for example, those described in U.S. Patent Nos. 5.032,450; 5,035,886, 5,071,645, and 5,14,438.

For higher quality ink-jet media, a separate upper image-forming layer may be formed above a carrier-absorbing layer. Accordingly, when the ink is ejected from the nozzle of the ink-jet printer in the form of individual droplets, the droplets pass through the upper layer where most of the dyes or pigments in the ink are retained or mordanted while the remaining dyes/pigments and the carrier portion of the ink pass freely through the upper layer to the carrier-absorbing layer where they arc rapidly absorbed, for example, by a hydrophilic polymer and/or microporous material. In this manner, large volumes of ink are quickly absorbed by the recording elements, giving rise to high quality recorded images having excellent optical density and good color gamut.

Image-forming layers in recording elements can also incorporate various known additives, including matting agents such as titanium dioxide, zinc oxide, silica, and polymeric beads such as polystyrene beads for the purposes of contributing to the non-blocking characteristics of the recording elements and to control the smudge resistance thereof; surfactants for improving the aging behavior of the ink-absorbing resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; dye-fixing agents; viscosity modifiers; waterproofing agents; dispersing agents; UV absorbing agents; mordants, and the like.

If desired, in addition to a coating according to the present invention, the recording element can be further coated with an ink-permeable, anti-tack, ink receptive coating, such as, for example, a hydrophilic cellulose derivative such as methyl cellulose, ethyl cellulose, hydroxyethyl cellulose, hydroxypropyl cellulose, sodium carboxymethyl cellulose, calcium carboxymethyl cellulose, methyethyl cellulose, methylhydroxyethyl cellulose, hydroxypropylmethyl cellulose, hydroxybutylmethyl cellulose, ethylhydroxyethyl cellulose, sodium carboxymethylhydroxyethyl cellulose, carboxymethylethyl cellulose, hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide; as well as hydroxyethyl cellulose grafted with alkyl C12-C14 chains.

The present invention is illustrated by the following examples. Unless otherwise indicated, the particle sizes herein are averages as determined by photon correlation spectroscopy.

PREPARATIVE EXAMPLES

The preparation of the epoxy particles (Epoxy-1 to Epoxy-7) used to form coated compositions according to the invention are described below.

Epoxy-1

An oil phase was prepared by dissolving in 42 grams of ethyl acetate, 1.5 grams of Carboset® 526 (an acrylic resin from B. F. Goodrich with an acid number of about 100), 12 grams of EPON™ 1001F (m.p. 60 to 70° C.), 0.12 grams of 2-undecylimidazole, 2 grams of acetone, 2 grams of isopropyl acohol, and 0.24 g of triethyl amine. The prepared oil phase was added to an aqueous phase containing 198 grams of water and 2 grams of Alkanol XC® surfactant under stirring to form an emulsion. The resultant emulsion was then passed three times through a Microfluidizer® mixer. Finally the volatile solvents were removed at room temperature under a stream of nitrogen. The resultant epoxy particle has a polymer (Carboset 526) to epoxy resin of 12.5:87.5 and a mean particle size of about 124.5 nm.

Epoxy-2

Epoxy-2 was prepared in a similar manner as Epoxy-1 except it has a ratio of polymer (Carboset® 526) to epoxy resin of 1:4 and a mean particle size of about 113 nm.

Epoxy-3

An oil phase was prepared by dissolving in 125.5 grams of ethyl acetate, 60 grams of EPON™ 1001F (m.p. 60 to 70° C.), 0.6 grams of 2-undecylimidazole, and 14 grams of acetone. The prepared oil phase was added to an aqueous phase containing 768 grams of water, 8 grams of Alkanol® XC surfactant (DuPont Corp.), and 24 grams of poly(vinyl pyrrolidone) (K-30 from International Specialty Products) under stirring to form an emulsion. The resultant emulsion was then passed three times through a Microfluidizer® mixer. Finally the volatile solvents were removed at room temperature under a stream of nitrogen. The resultant epoxy particle has a mean particle size of about 100.4 nm.

Epoxy-4

Epoxy-4 was prepared in a similar manner as Epoxy-3 except it contains about 12 grams of poly(vinyl pyrrolidone) and has a mean particle size of about 99.3 nm.

Epoxy-5

Epoxy-5 was prepared in a similar manner as Epoxy-3 except it contains about 6 grams of poly(vinyl pyrrolidone) and has a mean particle size of 110 nm.

Epoxy-6

Epoxy-6 was prepared in a similar manner as Epoxy-3 except it contains 6 grams of poly(vinyl alcohol) as the polymeric dispersant and has a mean particle size of about 120 nm.

Epoxy-7

An oil phase was prepared by dissolving in 42 grams of ethyl acetate, 3 grams of Carboset ®525 (an acrylic resin from B. F. Goodrich with an acid number of about 75), 12 grams of EPON™ 1001F (m.p. 60 to 70° C.), 2 grams of Aerosol OT® surfactant, 0.12 grams of 2-undecylimidazole, 2 grams of acetone, 2 grams of isopropyl acohol, and 0.35 g of triethyl amine. The prepared oil phase was added to an aqueous phase containing 200 grams of water under stirring to form an emulsion. The resultant emulsion was then passed three times through a Microfluidizer® mixer. Finally the volatile solvents were removed at room temperature under a stream of nitrogen. The resultant epoxy particle has a ratio of polymer (Carboset® 525) to epoxy resin of 1:4 and a mean particle size of about 92 nm.

The following preparative examples for Com-1 and Com-2 describe the preparation of a polyester polymer particle used in the comparative coating example:

COM-1

An oil phase was prepared by dissolving in 28 grams of ethyl acetate 12 grams of KAO-C® polymer (a polyester from KAO Corp.). The prepared oil phase was mixed with an aqueous phase containing 129.6 grams of water 1.44 grams of Alkanol XC® surfactant, and 4.8 grams of poly (vinyl pyrrolidone) under vigorous stirring. The resultant emulsion was then passed three times through a Microfluidizer® mixer. Finally the volatile solvents were removed at room temperature under a stream of nitrogen. The resultant polyester particle has a mean particle size of about 140 nm.

COM-2

An oil phase was prepared by combining 55 grams of a solution in methylene chloride containing 20% LF200® (a fluoropolymer resin from Zeneca Resins) and 20 grams of a solution in ethyl acetate containing 15% Carboset® 526 polymer. The prepared oil phase was then combined with 5 grams of isopropyl alcohol and 0.4 grams of triethyl amine. The oil phase was mixed with an aqueous phase containing about 3 grams of Alkanol XC® surfactant and 290 grams of water under vigorous stirring. The resultant emulsion was then passed three times through a Microfluidiser® mixer. The volatile organic solvent was removed. The resultant polymer particle has a mean particle size of about 180 nm.

Additional Materials (1) Poly(vinyl alcohol) (PVA) was obtained from Aldrich Chem. Co., Cat. No. 36,062-7.

(2) Poly(vinylpyrrolidone) K-30 was obtained from International Specialty Products.

Examples 1 Through 7

This Example illustrates the water-resistance of coatings according to the present invention. A series of coating examples were prepared as follows: A photographic paper support was used having a resin coated sublayer 1 (Titanox® and optical brightener in polyethylene) on one side and a resin coated sublayer 2 on the other side. The support was coated on the sublayer 1 side a gelatin layer have a dry coverage of about 3 grams/$m^2$. An overcoat layer was applied over the gelatin layer containing about 150 mg/$m^2$ MT-200 lubricant (Michelman Inc.), 50 mg/$m^2$ of Surfactant Olin® 10G (Olin Corp.), and various ingredients listed in Table 1 below. The gelatin was hardened with HAR-1.

TABLE 1

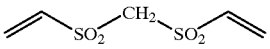

HAR-1

| Coating Examples | Gelatin (mg/$m^2$) | Polymer Particle ID | Polymer Particle Coverage (mg/$m^2$) | Poly(vinyl pyrrolidone) (mg/$m^2$) |
|---|---|---|---|---|
| Example 1 (Comparative) | 1300 | — | — | — |
| Example 2 (Invention) | — | Epoxy-2 | 1134 | — |
| Example 3 (Invention) | 195 | Epoxy-2 | 1134 | — |
| Example 4 (Invention) | 240 | Epoxy-2 | 1400 | — |
| Example 5 (Invention) | 195 | Epoxy-1 | 1134 | — |
| Example 6 (Invention) | 240 | Epoxy-1 | 1400 | — |
| Example 7 (invention) | — | Epoxy-1 | 1134 | 195 |

The above coating examples were tested for their resistance to water and a photographic paper developer by measuring the time it takes for the coating to reach 80% of its equilibrium swelling value in 0.1N NaCl aqueous solution and in RA-4 developer. The results are listed in Table 2 below.

TABLE 2

| Coating Examples | Developer Swelling (Second) | Water Swelling (Second) |
|---|---|---|
| Example 1 (Comparative) | 6 | 6 |
| Example 2 (Invention) | 15 | 198 |
| Example 3 (Invention) | 13.5 | 44 |
| Example 4 (Invention) | 16.5 | 62 |
| Example 5 (Invention) | 12 | 96 |
| Example 6 (Invention) | 18 | 72 |
| Example 7 (invention) | 13.5 | 116 |

The results in Table 2 above demonstrate that the coating examples prepared in accordance with the invention show excellent resistance to water penetration but have no significant effect on swelling by the photographic developer. Therefore the coating compositions of the invention are useful for forming protective overcoats for photographic elements and ink jet ink recording elements since those image elements require both developability by photographic developers or ink jet inks and resistance to water damage.

Examples 8 Thorugh 21

This Example illustrates the stain-resistance of coatings according to the present invention. A series coating examples were prepared as follows: A photographic paper support was used having a resin coated sublayer 1 (Titanox® and optical brightener in polyethylene) on one side and a resin coated sublayer 2 on the other side. The support was coated on the sublayer 1 side with a gelatin layer have a dry coverage of about 3 grams/$m^2$. An overcoat layer was applied over the gelatin layer containing about 150 mg/$m^2$ MT-200® lubricant (Michelman Inc.), 50 mg/$m^2$ of Surfactant Olin®10G (Olin Corp.), and various ingredients listed in Table 3. The gelatin was hardened with HAR-1.

TABLE 3

| Coating Examples | Gelatin (mg/$m^2$) | Polymer Particle ID | Polymer Particle Coverage (mg/$m^2$) | Poly(vinyl pyrrolidone) (mg/$m^2$) |
|---|---|---|---|---|
| Example 8 (Comparative) | 1300 | — | — | — |
| Example 9 (Invention) | — | Epoxy-2 | 1134 | — |
| Example 10 (Invention) | 195 | Epoxy-2 | 1134 | — |
| Example 11 (Invention) | 240 | Epoxy-2 | 1400 | — |
| Example 12 (Invention) | — | Epoxy-1 | 1134 | — |
| Example 13 (Invention) | 240 | Epoxy-1 | 1400 | — |
| Example 14 (invention) | — | Epoxy-1 | 1134 | 195 |
| Example 15 (Invention) | — | Epoxy-3 | 1134 | 470 |
| Example 16 (Invention) | 240 | Epoxy-3 | 1400 | 590 |
| Example 17 (Invention) | 195 | Epoxy-4 | 1134 | 240 |
| Example 18 (Invention) | 240 | Epoxy-4 | 1400 | 280 |
| Example 19 (Invention) | 240 | Epoxy-7 | 1400 | — |
| Example 20 (Comparative) | 240 | Com-1 | 1400 | 590 |
| Example 21 (Comparative) | 240 | Com-2 | 1134 | — |

The coatings processed through Kodak RA4 process. After the coatings were dried, they were subjected to further heat treatment between heated rollers, at least one of which was heated at a temperature of 300° F., at a speed of 60 inches per minute. The dye stain resistance was measured using a Ponceau Red dye solution prepared by dissolving 1 gram dye in 1000 grams mixture of acetic acid and water (5 parts: 95 parts). A drop of the dye solution was spread on the coating surface. The covered area had a diameter of about 2 cm. After 5 minutes the dye solution was rubbed off using a piece of paper towel. The samples were inspected visually and the stain resistance was measured by the amount of residual red color on the surface against the following scale:

| Value | Amount of residual color |
|---|---|
| A | No residual color |
| B | Trace amount of residual color |
| C | Very light residual color |
| D | Light residual color |
| E | Very heavy residual color |

The testing results are listed in Table 4 below.

TABLE 4

| Coating Examples | Dye Stain Resistance |
|---|---|
| Example 8 (Comparative) | E |
| Example 9 (Invention) | B |
| Example 10 (Invention) | B |
| Example 11 (Invention) | A |
| Example 12 (Invention) | A |
| Example 13 (Invention) | B |
| Example 14 (invention) | A |
| Example 15 (Invention) | A |
| Example 16 (Invention) | B |
| Example 17 (Invention) | B |
| Example 18 (Invention) | A |
| Example 19 (Invention) | B |
| Example 20 (Comparative) | E |
| Example 21 (Comparative) | D |

The results in Table 4 demonstrate that the coating examples prepared in according to the invention have excellent stain resistance. Comparative coating example 21 contains a fluopolymer particle and it shows only marginal improvement on dye stain. Comparative coating example 20 contains a polyester particle and it does not show any improvement on dye stain.

Examples 22 Through 26

Photographic elements were prepared by coating in sequence blue-light sensitive layer, interlayer, green-light sensitive layer, UV layer, red-light sensitive layer, UV layer and overcoat on photographic paper support. The components in each individual layer is described below. The overcoat layer for Examples 23 through contains about 150 mg/m$^2$ MT-200® lubricant (Michelman Inc.), 50 mg/m$^2$ of Surfactant Olin® 10G (Olin Corp.), and various ingredients listed in Table 5. Comparative Example 22 has an overcoat containing 600 mg/m$^2$ of gelatin and 150 mg/m$^2$ of colloidal silica (Ludox® AM). Gelatin was hardened using HAR-1.

| | |
|---|---|
| UV | 12.11 UV-1 |
| | 2.13 UV-2 |
| | 3.57 SCV-1 |

-continued

| | |
|---|---|
| | 2.37 S-1 |
| | 2.37 S-2 |
| | 47.5 Gelatin |
| Cyan | 18.1 Red light sensitive AgX |
| | 39.31 C-1 |
| | 38.52 S-2 |
| | 3.22 S-3 |
| | 25.31 UV-1 |
| | 129.0 Gelatin |
| UV | 17.43 UV-1 |
| | 3.07 UV-2 |
| | 5.14 SCV-1 |
| | 3.41 S-1 |
| | 3.41 S-2 |
| | 68.4 Gelatin |
| Magenta | 7.70 Green-light sensitive AgX |
| | 1.11 KCL |
| | 29.5 C-2 |
| | 8.26 S-2 |
| | 3.54 S-4 |
| | 17.7 ST-1 |
| | 2.01 ST-2 |
| | 57.0 ST-3 |
| | 0.05 FOG-1 |
| | 0.285 Nitric Acid |
| | 117.0 Gelatin |
| Layer | Laydown (mg/sq. ft.) |
| IL | 6.12 SCV-1 |
| | 18.4 S-2 |
| | 6.025 3,5-Disulfocatechol disodium salt |
| | 0.524 Nitric Acid |
| | 0.18 SURF-1 |
| | 70.0 Gelatin |
| Yellow | 24.0 Blue-light sensitive AgX |
| | 45.0 C-3 |
| | 45.0 P-1 |
| | 20.3 S-2 |
| | 0.88 SCV-2 |
| | 141.8 Gelatin |

Photographic paper support sublayer 1: resin coat (Titanox and optic brightener in polyethylene)

sublayer 2: paper sublayer 3: resin coat (polyethylene)

C-1 Butanamide 2-[2,4-bis(1,1-dimethylpropyl)phenoxy]-N-(3,5-dichloro-4-ethyl-2-hydroxyphenyl)

C-2

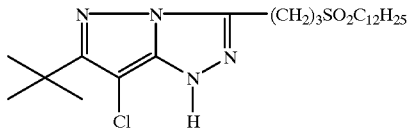

C-3

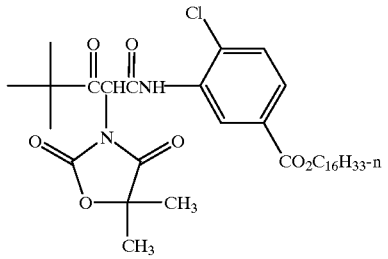

-continued

FOG-1

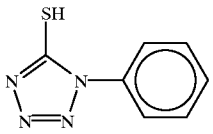

HAR-1

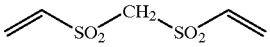

P-1

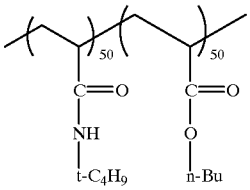

S-1 1,4-Cyclohexylenedimethylene bis(2-ethylhexaneoate)

S-2

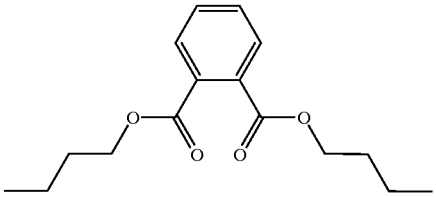

S-3 2-(2-Butoxyethoxy)ethyl acetate

S-4 Di-undecylphthalate

SCV-1

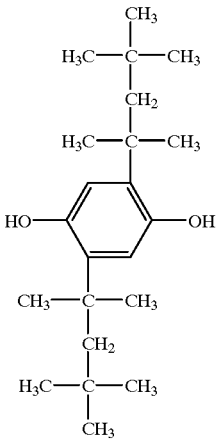

SCV-2 benzenesulfonic acid 2,5-dihydroxy-4-(1-methylheptadecyl)-mono-potassium salt

ST-1

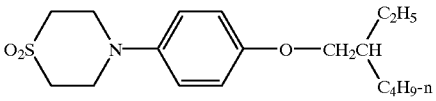

ST-2

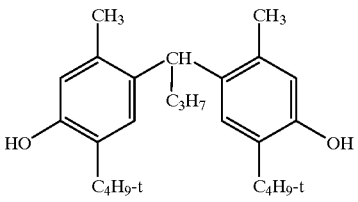

-continued

ST-3

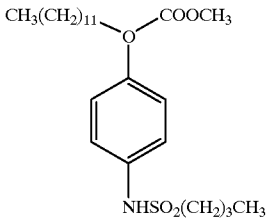

SURF-1

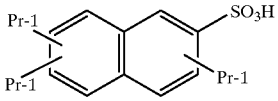

.1 Na

SURF-2 $C_8F_{17}SO_3N(C_2H_5)_4$

UV-1

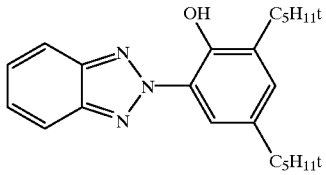

UV-2

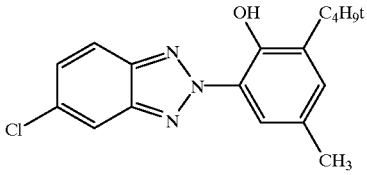

TABLE 5

| Coating Examples | Gelatin ($mg/m^2$) | Polymer Particle ID | Polymer Particle Coverage ($mg/m^2$) | Poly(vinyl alcohol) ($mg/m^2$) |
|---|---|---|---|---|
| Example 23 (Invention) | 240 | Epoxy-1 | 1400 | — |
| Example 24 (Invention) | 275 | Epoxy-1 | 1600 | — |
| Example 25 (invention) | 275 | Epoxy-1 | 1600 | 100 |
| Example 26 (Invention) | 367 | Epoxy-1 | 1600 | — |

The coatings processed through Kodak RA4 process. After the coatings were dried, they were subjected to further heat treatment between heated rollers, at least one of which was heated at a temperature of 300° F., at a speed of 60 inches per minute. The dye stain resistance was measured using a Ponceau Red dye solution as before. The results are listed in Table 6.

TABLE 6

| Coating Examples | Dye Stain Resistance |
|---|---|
| Example 22 (Comparative) | E |
| Example 23 (Invention) | A |
| Example 24 | A |

TABLE 6-continued

| Coating Examples | Dye Stain Resistance |
|---|---|
| (Invention) Example 25 (Invention) | B |
| Example 26 (Invention) | A |

Results in Table 6 demonstrate that the photographic elements prepared in according to the present invention have excellent dye stain resistance.

The invention has been described in detail with particular reference to certain preferred embodiments thereof, but it will be understood that variations and modifications can be effected within the spirit and scope of the invention.

What is claimed is:

1. A method of making an imaged print having a water-resistant overcoat, which method comprises in order the following:

(a) providing an imaging element comprising a support, at least one image-receiving layer, and overlying the at least one image-receiving layer at least one layer having a laydown of at least 0.54 g/m$^2$ (50 mg/ft$^2$) of an overcoat composition comprising water-dispersible particles having an average particle size of from 0.01 to 5 microns and a Tg of greater than 20° C., which particles comprise an epoxy material, having on average at least 1.5 epoxy groups per molecule, and a hydrophilic polymer; and (b) forming an dye or pigment based pictorial image in the image-receiving layer using ink jet or a developing agent, and (c) fusing the overcoat at a temperature over 100° C. to render the overcoat water-resistant in the final product.

2. The method of claim 1, wherein the overcoat further comprises a polymer having an acid number between 30 and 250, wherein the acid groups carried by the polymer have been neutralized by a base to a degree of neutralization of 50 to 90%, and wherein at least a portion of the epoxy groups react with the acid groups of the polymer during fusing.

3. The method of claim 1 wherein the hydrophilic polymer is gelatin or poly(vinylpyrrolidone).

4. The method of claim 1 wherein the epoxy material is selected from the group consisting of epoxy resin is a diglycidyl ether of a dihydric phenol.

5. The method of claim 1 wherein the image receiving layer comprises a silver-halide emulsion.

6. A method of making a photographic print having a water-resistant overcoat, which method comprises in order:

(a) providing a photographic element comprising a support, at least one image-receiving silver-halide emulsion layer, and overlying the at least one emulsion layer at least one layer having a laydown of at least 0.54 g/m$^2$ (50 mg/ft$^2$) of an overcoat composition comprising water-dispersible latex particles having an average particle size of from 0.01 to 0.5 microns and a Tg of greater than 20° C., which particles comprise an epoxy material, having on average at least 1.5 epoxy groups per molecule, and a hydrophilic polymer;

(b) image-wise exposing the photographic element to light;

(c) forming an dye-based pictorial image in the image-receiving layer using a developing agent, and (d) fusing the overcoat at a temperature over 100° C. to render the overcoat water-resistant in the final product.

7. An imaging element having a nascent water-resistant protective overcoat thereon, comprising the following:

(a) a support;

(b) at least one image-receiving layer for carrying a dye or pigment-based pictorial image; and (c) overlying the at least one image-receiving layer at least one layer having a laydown of at least 0.54 g/m$^2$(50 mg/ft$^2$) of a coating composition comprising (i) water-dispersible particles having an average particle size of from 0.01 to 5 microns and a Tg of greater than 20° C., which particles comprise an epoxy-containing material containing on average at least 1.5 epoxy groups per molecule, and (ii) a hydrophilic binder selected from the group consisting of gelatin, polyvinylpyrrolidone, and combinations thereof.

8. The imaging element of claim 7 wherein the epoxy material is selected from the group consisting of epoxy resin is a diglycidyl ether of a dihydric phenol.

9. The imaging element of claim 7 wherein the image receiving layer comprises a silver-halide emulsion.

10. The imaging element of claim 7 wherein the overcoat further comprises a polymer having an acid number between 30 and 250, wherein the acid groups carried by the polymer have been neutralized by a base to a degree of neutralization of 50 to 95%.

11. The imaging element of claim 10 wherein the polymer comprises a repeat unit derived from a monomer selected from the group consisting of acrylic acid, methacrylic acid, and itaconic acid.

12. The imaging element of claim 7 wherein the support comprises polymeric films, papers or glass.

13. The imaging element of claim 7 wherein the overcoat composition further comprises UV absorbers, surfactants, emulsifiers, coating aids, lubricants, matte particles, rheology modifiers, crosslinking agents, antifoggants, inorganic fillers, pigments, magnetic particles and/or biocides.

14. An imaged element having a water-resistant protective overcoat thereon, comprising the following:

(a) a support;

(b) at least one image-receiving layer for carrying a dye or pigment-based pictorial image; and (c) overlying the at least one image-receiving layer a protective overcoat having a laydown of at least 0.54 g/m$^2$ (50 mg/ft$^2$) and comprising the fused reaction product of an epoxy material having an average particle size of from 0.01 to 5 microns and a Tg of greater than 20° C., containing on average at least 1.5 epoxy groups per molecule, and a polymer having an acid number between 30 and 250, wherein the acid groups carried by the polymer have been neutralized by a base to a degree of neutralization of 50 to 95%, said overcoat further comprising a binder comprising gelatin and/or poly (vinylpyrrolidone).

15. The imaging element of claim 14 wherein the image is based on ink-jet.

16. The imaging element of claim 15 wherein the image is based on the reaction of a coupler with a developing agent in the presence of silver-halide emulsion.

* * * * *